US006182044B1

(12) United States Patent
Fong et al.

(10) Patent No.: US 6,182,044 B1
(45) Date of Patent: Jan. 30, 2001

(54) SYSTEM AND METHODS FOR ANALYZING AND CRITIQUING A VOCAL PERFORMANCE

(75) Inventors: Philip W. Fong, Pleasantville; Nelson B. Strother, Shenorock, both of NY (US)

(73) Assignee: International Business Machines Corporation, Armonk, NY (US)

( * ) Notice: Under 35 U.S.C. 154(b), the term of this patent shall be extended for 0 days.

(21) Appl. No.: 09/145,322

(22) Filed: Sep. 1, 1998

(51) Int. Cl.[7] ..... G10L 21/00
(52) U.S. Cl. ..... 704/270; 704/207
(58) Field of Search ..... 434/307; 84/477, 84/609, 610, 612; 704/270, 278, 246

(56) References Cited

U.S. PATENT DOCUMENTS

| | | | | |
|---|---|---|---|---|
| 5,548,647 | * | 8/1996 | Naik et al. | 704/200 |
| 5,651,095 | * | 7/1997 | Ogden | 704/260 |
| 5,659,664 | * | 8/1997 | Kaja | 704/265 |
| 5,727,120 | * | 3/1998 | Van Coile et al. | 704/206 |
| 5,728,960 | * | 3/1998 | Sitrick | 84/477 R |
| 5,857,171 | * | 1/1999 | Kageyama et al. | 704/268 |
| 5,905,972 | * | 5/1999 | Huang et al. | 704/268 |
| 5,913,194 | * | 6/1999 | Karaali et al. | 704/259 |

OTHER PUBLICATIONS

Yoshida et al, "A New Method of Generating Speech Synthesis Units . . . ", ICLSP 1996.*
Masuko et al, "Voice Characteristics Conversion of HMM Based Speech synthesis System", ICASSP 1997.*
Saito et al, High Quality Speech Synthesis using Context Dependent Syllabic Units, ICASSP, 1996.*

* cited by examiner

*Primary Examiner*—Krista Zele
*Assistant Examiner*—Michael N. Opsasnick
(74) *Attorney, Agent, or Firm*—F. Chau & Associates, LLP

(57) ABSTRACT

System and methods for analyzing a vocal performance by automatically critiquing pitch, rhythm and pronunciation or diction of a singer in accordance with pre-programmed criteria. In one aspect, a method for analyzing a vocal performance comprises the steps of capturing the acoustic utterances of a user's vocal performance (singing a song); extracting pitch information from each frame of the acoustic utterances; extracting phonetic information from each frame of the acoustic utterances; combining the extracted pitch information and phonetic information of corresponding frames to generate an encoded representation of the current vocal performance; comparing the encoded representation of the current vocal performance with an encoded reference vocal performance (or the same user or a different person) having pitch and phonetic information associated therewith to determine if a variation between either pitch information, the phonetic information, or both, of the encoded current vocal performance and of the encoded reference vocal performance is within a predetermined, user-specified tolerance; and critiquing the user's current vocal performance if the variation is determined to exceed the predetermined tolerance.

26 Claims, 4 Drawing Sheets

SYSTEM AND METHODS FOR ANALYZING AND CRITIQUING A VOCAL PERFORMANCE

BACKGROUND

1. Technical Field

The present application relates generally to system and methods for automatic vocal coaching and, more particularly, to system and methods for automatically critiquing the pitch, rhythm and pronunciation or diction of a vocal performance of a singer in accordance with pre-programmed criteria.

2. Description of the Related Art

It is often useful for a person who aspires to be a singer to have his/her vocal performance critiqued by a professional singing coach on a regular basis so that the person's singing skills can be sharpened. For instance, critiquing a person's pitch, rhythm, and diction during a vocal performance can help the person identify and focus on any weaknesses or shortcomings of his/her singing technique or style, which helps improve the person's singing ability. Unfortunately, few singers have a professional singing coach available on a continuous basis, and may unknowingly lapse into errors during their private practice sessions.

There are some commercially available interactive multimedia software programs which allow a person to practice his/her singing skills at his/her own pace and convenience. These multimedia programs, however, are limited and do not provide the level of guidance and assistance that a professional singing coach can provide. For instance, the multimedia program SING! by Musicware Inc. is one example of such software. The SING! program is very limited since it only deals with pitch and rhythm and cannot analyze songs. In particular, the user is provided with a series of vocal exercises in a certain sequence that the user must perform and the program checks the exercises. Accordingly, there is a need for an interactive multimedia vocal coaching system that can provide the level or breadth of guidance that a singer can receive from a professional vocal coach.

SUMMARY

The present application is directed to system and methods for providing vocal coaching by automatically critiquing pitch, rhythm and pronunciation or diction of a vocal performance of a singer in accordance with pre-programmed criteria.

In one aspect, a system for analyzing a vocal performance, comprises:

means for receiving input utterances corresponding to a current vocal performance;

means for extracting pitch information from the input utterances of the current vocal performance;

means for extracting phonetic information from the input utterances of the vocal performance;

means for combining and encoding the pitch and phonetic information into an encoded representation of the vocal performance; and means for outputting the encoded representation.

In another aspect, a method for analyzing a vocal performance, comprises the steps of:

providing acoustic utterances corresponding to a current vocal performance; extracting pitch information from the acoustic utterances;

extracting phonetic information from the acoustic utterances;

combining the extracted pitch and phonetic information into an encoded representation of the current vocal performance;

comparing the encoded representation of the current vocal performance with a corresponding encoded reference performance having pitch and phonetic information associated therewith; and providing a critique if one of the pitch information and the phonetic information of the encoded current vocal performance varies from the corresponding pitch and phonetic information of the encoded reference performance.

These and other objects, features and advantages of the present system and methods will become apparent from the following detailed description of illustrative embodiments, which is to be read in connection with the accompanying drawings.

DETAILED DESCRIPTION OF PREFERRED EMBODIMENTS

Figure 1:
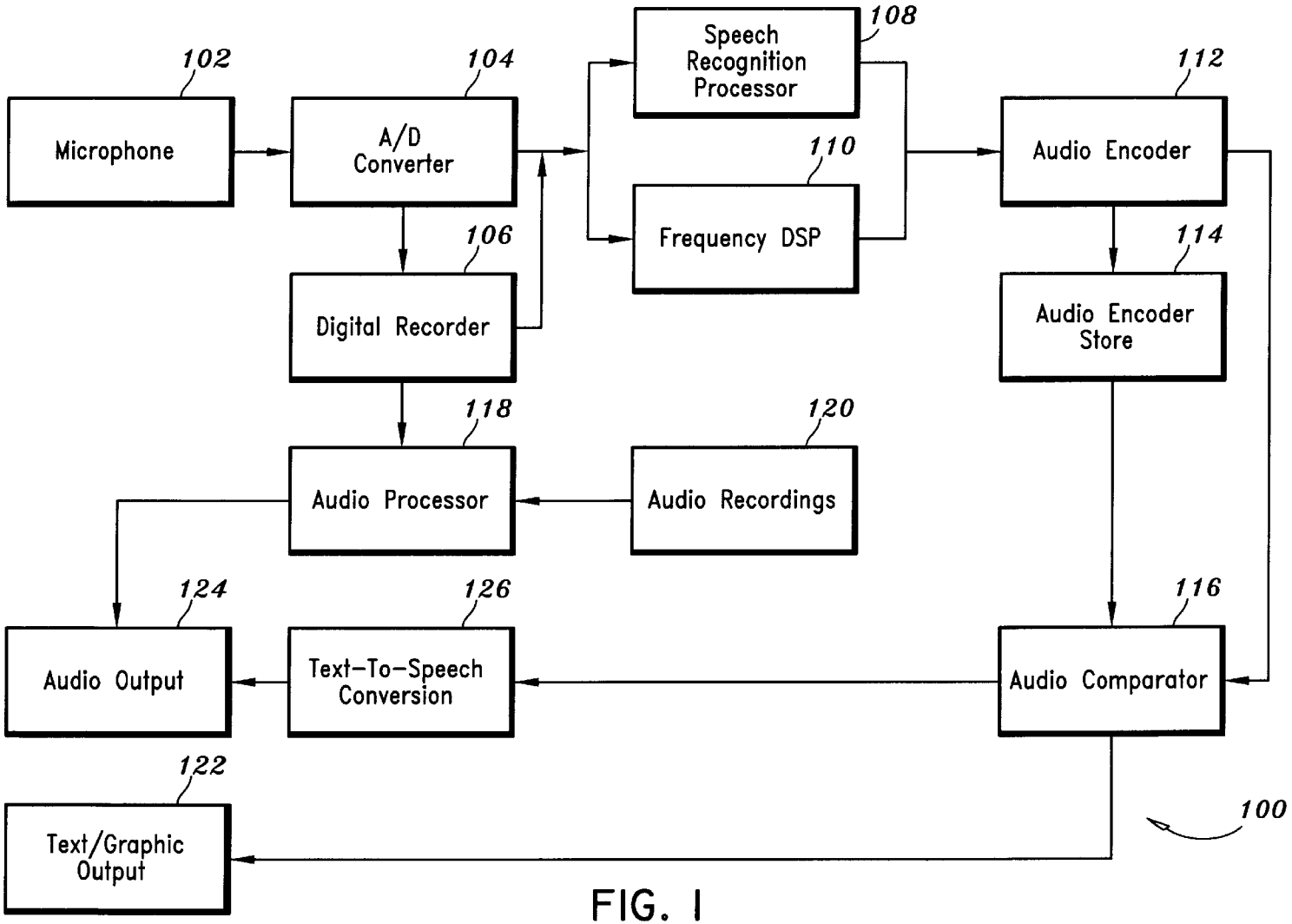
FIG. 1 is a block/flow diagram illustrating an automatic vocal coaching system in accordance with one embodiment of the present invention.

Referring to FIG. 1, an automatic vocal coaching system in accordance with one embodiment is shown. It is to be understood that the depiction of the automatic vocal coaching system of FIG. 1 could also be considered as a flow diagram of a method for automatic vocal coaching. A microphone 102 (or any similar electroacoustic device) receives and converts acoustic signals (e.g., a vocal performance) into analog electrical signals. An analog to digital (A/D) converter 104 converts the acoustic analog electrical signals into digital signals. A digital recorder 106 is operatively connected to the A/D converter 104 for recording and storing the digitized version of, e.g., the vocal performance of a singer.

A frequency digital signal processor 110 ("frequency DSP"), operatively connected to the A/D converter 104, receives and processes the digitized acoustic signals. In particular, the frequency DSP 110 extracts the fundamental frequency or pitch information from the acoustic signals by processing the digital acoustic signals in successive time intervals. The processed acoustic signals are represented by a series of vectors which represent the determined pitches (i.e., frequencies) as they vary over time for the particular time interval.

It is to be understood that, although any conventional frequency extraction method may be used in the present system and that the present system is not limited to use with or dependent on any details or methodologies of any particular frequency extraction method, a preferred method is the one described in the paper by Dik J. Hermes entitled: "Measurement of Pitch By Subharmonic Summation," Journal of the Acoustical Society of America, January, 1988, Volume 83, Number 1, pp. 257–263. With this method, the pitch of the acoustic signals is determined by subsampling an interval of data with a cubic spline interpolation. A Fast Fourier Transform (FFT) is then applied and the results are shifted into the logarithmic domain with a cubic spline interpolation. The result is shifted and summed with itself for a specified number of times. The largest peak that remains after summation is taken as the estimate of the pitch.

The system also includes a speech recognition processor 108, operatively connected to the A/D converter 104, for processing the digitized acoustic signals and generating phonetic information which represents a particular utterance or phonetic sound present in each of successive time intervals. Specifically, the speech recognition processor 108 compares the presence or absence of acoustic energy at various frequencies across a portion of the audible spectrum in each of the successive time intervals of the digital representation of the vocal performance, for example, with similar acoustic energy collected from known acoustic utterances, and then generates statistical data for the particular utterance (i.e., phonetic sound) present in each of the successive time intervals from which the phonetic information may be derived. Such a comparison can be accomplished using conventional speech recognition techniques such as those based on Viterbi alignment or Hidden Markov models. Although the present system is not limited to use with or dependent on any details or methodologies of any particular speech recognition system, a preferred speech recognition system is the one disclosed in the article by Bahl et al., entitled: "Performance Of The IBM Large Vocabulary Continuous Speech Recognition System On The ARPA Wall Street Journal Task", Proceedings of the IEEE International Conference on Acoustics, Speech and Signal Processing, ICASSP-95, Detroit, May, 1995.

It is to be understood that the time intervals at which the frequency DSP 110 and the speech recognition processor 108 process the digitized input utterances depends on the given configuration or implementation of the system. The processing time interval for the frequency DSP 110 and the speech recognition processor may be equal or different. In addition, the pitch and phonetic information can be processed and extracted in real-time (i.e., for each of the respective successive time intervals) during the vocal performance. Alternatively, real-time processing can be performed by extracting pitch or phonetic information from blocks of successive time intervals. It is to be further understood that pitch and phonetic information may be extracted subsequent to the vocal performance of a song. For example, the vocal performance may first be recorded and stored by the digital recorder 106, and then subsequently retrieved and processed by the frequency DSP 110 and the speech recognition processor.

Referring again to FIG. 1, the vocal coaching system 100 includes an audio encoder 112 which processes the phonetic and pitch information received from the speech recognition processor 108 and the frequency DSP 110, respectively. In particular, the audio encoder 112 combines and encodes the pitch and phonetic information into a form that is, essentially, a representation of the time-varying sequence of pitches and phonetic sound information which are extracted by the frequency DSP 110 and the speech recognition processor 108, respectively, in each of the respective successive time intervals for the entire duration of the vocal performance. For example, assuming the processing time intervals are equal, one embodiment of the encoded representation for each successive time interval is as follows: the pitch and phonetic sound extracted during a corresponding time interval, with each successive time interval having a pitch and phonetic sound associated therewith.

It is to be appreciated that the audio encoder 112 may be configured to enhance the pitch information by averaging the pitch information for a given number of successive time intervals where the change in pitch is below a specified threshold. This provides a more accurate simulation of the psychoacoustical process and mitigates the effects of erroneously extracted pitch information. The encoded representation of the vocal performance generated by the audio encoder 112 is stored in an audio encoder store 114. It is to be appreciated that any one of the stored encoded representations may be output (e.g., via a printer) for manual analysis (i.e., a supplement to the automatic analysis provided by the present system). In addition, the encoded representation may be output as a transcription which can be used as an alternate form of musical notation (i.e., the transcription is essentially equivalent to sheet music with lyrics).

Next, a programmable audio comparator 116, operatively connected to the audio encoder 112 and the audio encoder store 114, compares the encoded representation of a current vocal performance with either an encoded representation of a reference performance or parameters associated with a selected song style and generates "critique" data. For instance, as explained in further detail below, the audio comparator 116 is pre-programmed to, inter alia, detect instances where variations between any of the extracted features (i.e., timing, pitch, sound) of a current vocal performance of a song and a previous performance of the same song (i.e., reference performance) exceed a user-specified level (i.e., tolerance), and provide information of such variations (i.e, critique the current performance). In other instances (also explained in further detail below), the audio comparator 116 may be programmed to compare the extracted features of a current vocal performance with unique features and characteristics of a particular singing style, the parameters of which are stored in the vocal coaching system 100. This allows a singer to be critiqued on his/her attempt to conform to the particular singing style.

A text/graphic output display 122, operatively connected to the audio comparator 116, displays critique data received from the audio comparator 116 in either text or graphic form during and/or subsequent to a vocal performance. In addition, a text-to-speech converter 126 (of any conventional type), operatively connected between the audio output 124 and the audio comparator 116, converts critique data (in machine readable form) received from the audio comparator 116 into corresponding electroacoustic signals which are then output from an audio output unit 124 which provides the singer with an audible critique. It is to be appreciated that the text-to-speech converter 126 may also be used to process a desired one of the encoded representations stored in the audio encoder store 114, in which case the information from the encoded representation can be used to simulate singing and any errors of the encoded performance can be demonstrated (via the comparator 116).

It is to be understood that the text/graphic output display 122 may be any conventional display device such as a computer monitor with a suitable graphical user interface (GUI), or a printing device. The audio output unit 124 may be any conventional electroacoustical device which converts electrical signals into acoustical waves such as a speaker or headphones.

An audio processor 118 is preferably provided for converting digitized vocal performances stored in the digital recorder 106 into electoacoustic signals which are output from the audio output unit 124. In addition, an audio recordings unit 120 (e.g. any conventional compact disk read only memory (CD Rom) or digital versatile disk (DVD)

drive unit) is preferably included for receiving digital recordings of songs (e.g., CDs or DVDS) which are processed by the audio processor 118 and output via the audio output unit 124. This multimedia feature allows a singer to perform a song with some musical accompaniment so as to provide pitch and rhythmic cues for facilitating the vocal performance. Generally, the vocal coaching system can critique an individual who sings a cappella (singing a song unaccompanied by music). Most singers, however, will be comfortable using the vocal coaching system 100 with some musical accompaniment to provide pitch and rhythmic cues for the vocal performance. Of course, when utilizing such feature, a noise-cancelling microphone 102 may be used to compress the background noise (e.g., the musical accompaniment). Indeed, the acoustic signal associated with the musical accompaniment will be of a low enough intensity in the digital representation of the singing that it will not distort the information (e.g., pitch and sound) extracted from the singing performance. If a musical accompaniment of greater intensity is desired, headphones may be used (as opposed to speakers) as the audio output unit 124.

It is to be understood that the present system and methods described herein may be implemented in various forms of hardware, software, firmware, or a combination thereof. In particular, functional modules of the present system, e.g., the speech recognition processor 108, the frequency DSP 110, the audio encoder 112, the audio comparator 110, and the text-to speech converter 126, are preferably implemented in software and may include any suitable and preferred processor architecture for implementing the vocal coaching methods described herein by programming one or more general purpose processors. It is to be further understood that, because some of the system elements described herein are preferably implemented as software modules, the actual connections shown in FIG. 1 may differ depending upon the manner in which the present system is programmed. Of course, special purpose processors may be employed to implement the present system. Given the teachings herein, one of ordinary skill in the related art will be able to contemplate these and similar implementations of the elements of the present system.

The automatic vocal coaching system 100 of FIG. 1 is preferably implemented on a computer platform including hardware such as one or more central processing units (CPU), a random access memory (RAM), non-volatile hard-disk memory and various input/output (I/O) interfaces. The computer platform also includes an operating system and may include microinstruction code. The various processes and functions described herein such as speech recognition and frequency digital signal processing may be part of one or more application programs which are executed via the operating system. In addition, various peripheral devices may be connected to the computer platform such as a terminal, a data storage device and a printing device.

Figure 2:
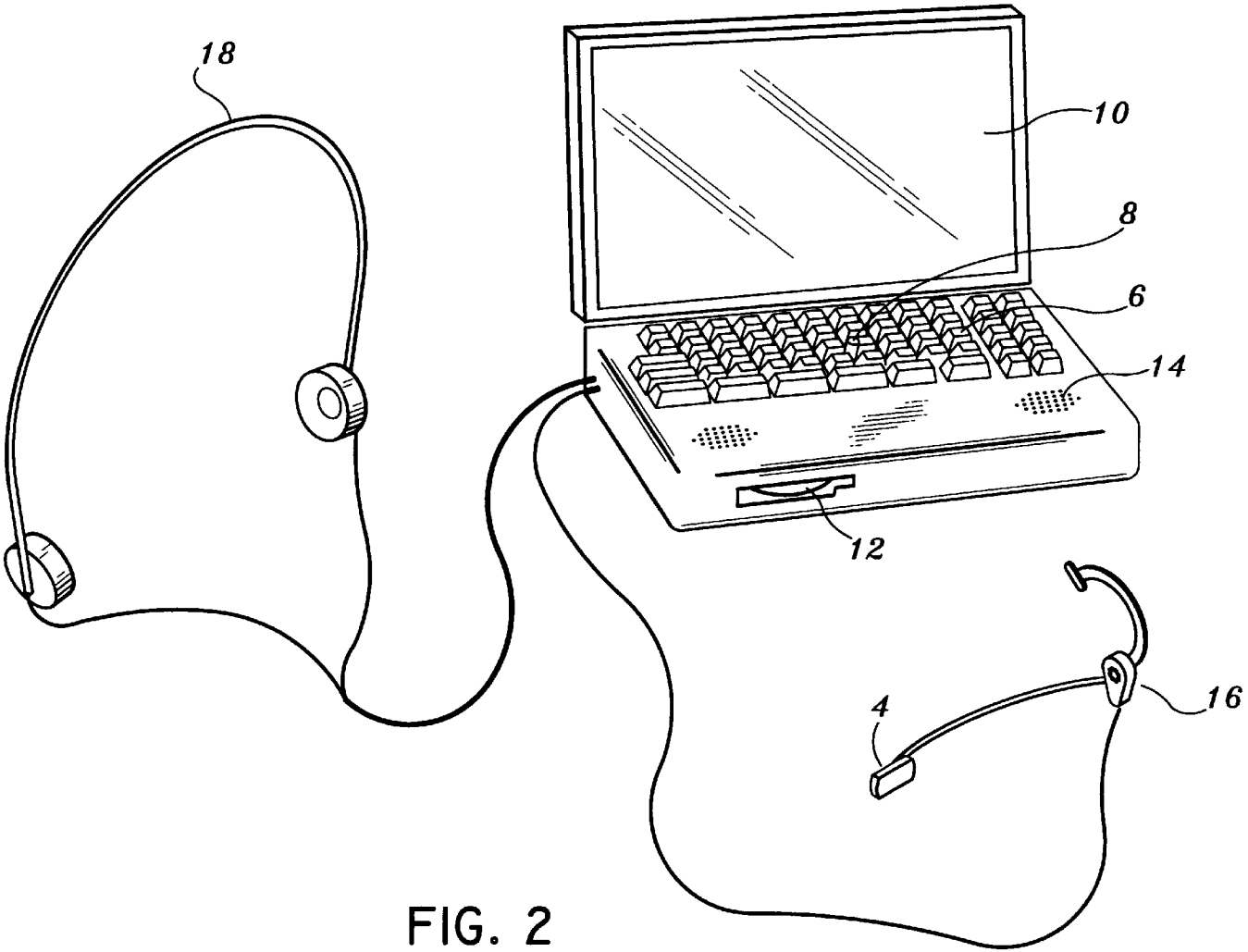
FIG. 2 is a diagram illustrating a portable device for implementing the system of FIG. 1.

It is to be appreciated that, while the vocal coaching system may be embedded in a large, stationary computer, it would be advantageous for the computer (in which the present system may be embedded) to be small and portable, such as a mobile computer or a notebook computer. For instance, FIG. 2 illustrates a conventional notebook computer in which the vocal coaching system 100 may be implemented. The singer (i.e., user of the vocal coaching system) will interact with the computer through a microphone 4, as well as a keyboard 6, a pointing device 8 (e.g., a mouse) and a display 10. As stated above, for some applications of the present vocal coaching system, the computer platform preferably includes multimedia features such as an audio system which can reproduce audio recordings such as those found on CDs or DVDs 12 through either a loudspeaker 14, earpiece 16 or a set of headphones 18.

Figure 3:
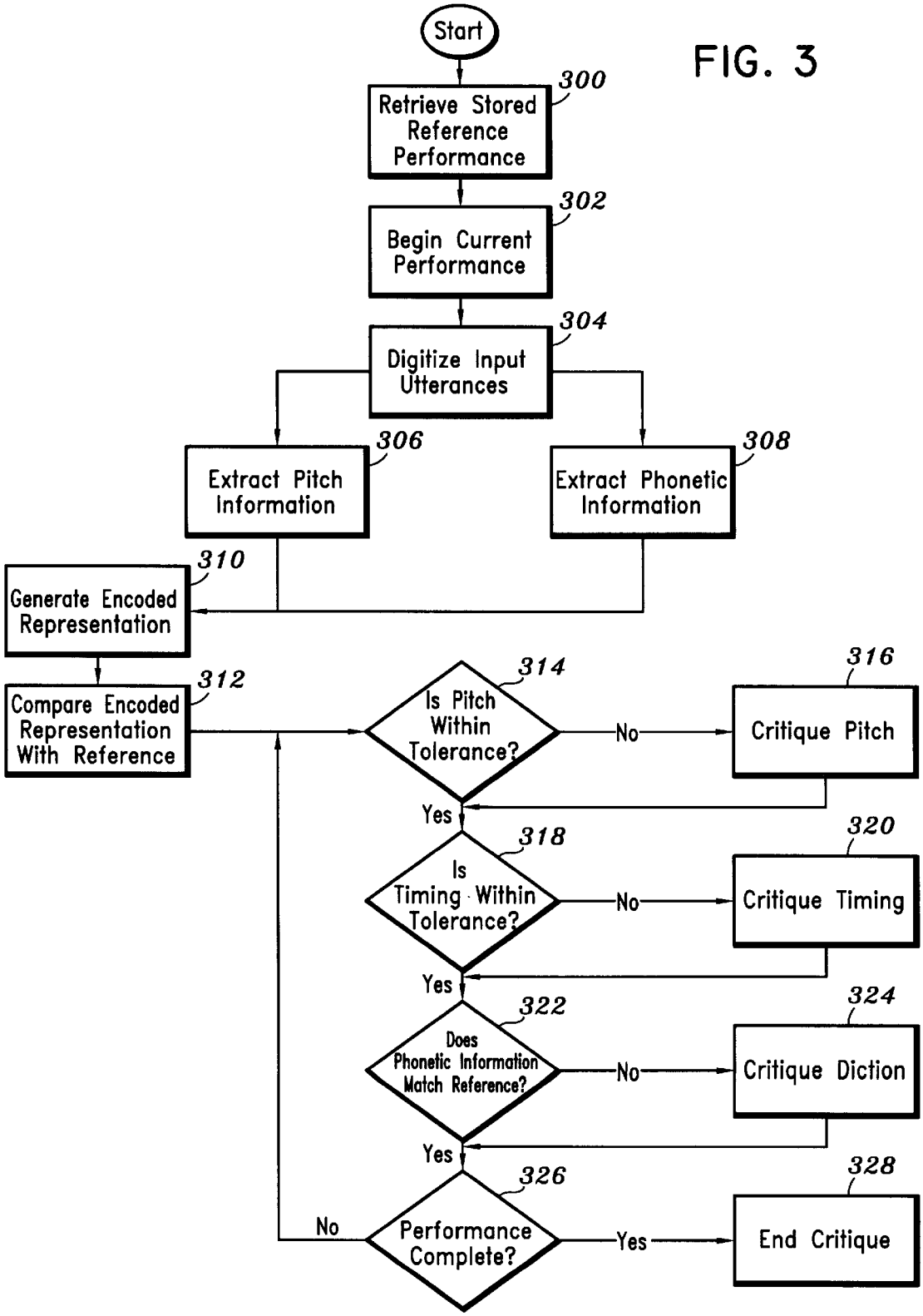
FIG. 3 is a flow diagram illustrating a method for providing automatic vocal coaching in accordance with one aspect of the present invention.

As indicated above, the automatic vocal coaching system may be configured and implemented in various applications to critique the vocal performance of a singer. For instance, the computer-based vocal coaching system may be programmed to critique a current vocal performance by comparing the current performance with an encoded representation of a previous performance (i.e, reference) of the same song which is stored in the system 100. This method will now be explained in detail with reference to the flow diagram of FIG. 3, as well as the system in FIG. 1.

Initially, the user (e.g., singer) will retrieve (from the audio encoder store module 114) a previously stored reference performance of a song that the user desires to sing (step 300). As discussed above, the encoded representation of the reference performance is the time-varying sequence of pitches and phonetic sound information which was extracted by the vocal coaching system during a previous vocal performance. The reference performance could have been provided by the same singer or a different singer. In addition, the encoded reference performance can be manually created and programmed into the system. In either scenario, the retrieved reference performance is loaded into the audio comparator 116.

Next, acoustic signals corresponding to a current vocal performance of the desired song by the user are input into the system (via the microphone 102) (step 302), and the acoustic signals are converted into digital signals via the A/D converter 104 (step 304). The digital signals are then processed in successive time intervals by the frequency DSP 110 to extract the pitch information (i.e. frequency) in each of the corresponding time intervals (step 306). Simultaneously with frequency extraction, the speech recognition processor 108 processes the digital signals in successive time intervals to generate phonetic information (step 308) which represents the particular utterance or phonetic sound in the corresponding time intervals.

It is to be understood that while it is preferred that the steps of frequency extraction and the generation of phonetic information occur simultaneously during real-time processing, the present system may be configured such that step 306 occurs immediately before step 308 or vice versa during real-time or non-real-time processing.

The frequency and phonetic information extracted by the frequency DSP 110 and the speech recognition processor 108, respectively, is sent to the audio encoder 112 which generates an encoded representation of the digital acoustic signals (step 310). As stated above, the encoded representation may be in a form such as the following: A pitch of 262 Hz and a phonetic sound of a long "A" which occurs during a certain time interval. Each subsequent change in pitch or change in phonetic sound is extracted and encoded in a similar fashion for each of the respective successive time intervals or blocks.

Next, during the vocal performance, the pitch and phonetic information extracted and encoded from the current performance for each of the respective successive time intervals or blocks is compared (via the audio comparator 116) with the pitch and phonetic information of corresponding time intervals of an encoded reference performance (step 312). In particular, for each of the respective successive time intervals, the audio comparator 116 compares the pitch information of the current performance with the pitch information from the corresponding time intervals of the encoded reference performance to determine if the pitch of the current performance is within a specified tolerance (i.e, range) of the pitch of the reference performance (step 314). If it is determined that the current pitch is not within the corresponding user-specified tolerance (negative result in step 314), the audio comparator 116 will provide critique information regarding the singer's pitch (step 316). In addition, for each of the respective time intervals or blocks, the audio comparator 116 will determine if the timing of the change of the encoded phonetic information of the current performance falls within a specified tolerance of the timing change of the phonetic information of the corresponding time intervals of the encoded reference performance (step 318). If the timing of the current performance does not fall within the user-specified tolerance (negative result in step 318), the audio comparator 116 will provide critique information regarding the singer's timing (step 320). Moreover, the audio comparator 116 will determine if the encoded phonetic information of the current performance matches the phonetic information of the encoded reference performance (step 322). If it is determined that the encoded phonetic information of the current performance does not match the encoded phonetic information of the encoded reference performance within a specified tolerance (negative result in step 322), the audio comparator 116 will provide critique information regarding the singer's diction (step 326). This process (steps 314, 316, 318, 329, 322 and 324) is repeated for each of the respective time intervals or blocks until the vocal performance has finished (step 326), in which case the critique process will terminate (step 328).

It is to be appreciated that, as indicated above, the critique information may be provided textually or graphically on the text/graphic output display 122 or as an audible signal delivered via the audio output unit 124 (e.g., loudspeakers or headphones). It is to be further appreciated that the critique information may be provided in real-time (contemporaneously with the singer's performance) or summarized at the end of each line or phrase within the song structure. Alternatively, the critique of a singer's performance can be provided as a batch critique which can be viewed or heard once the vocal performance has ended. In addition, the vocal coaching system 100 can be programmed to reproduce a digital recording of the current performance so that the singer can hear his/her vocal performance concurrently with the batch critique.

Figure 4:
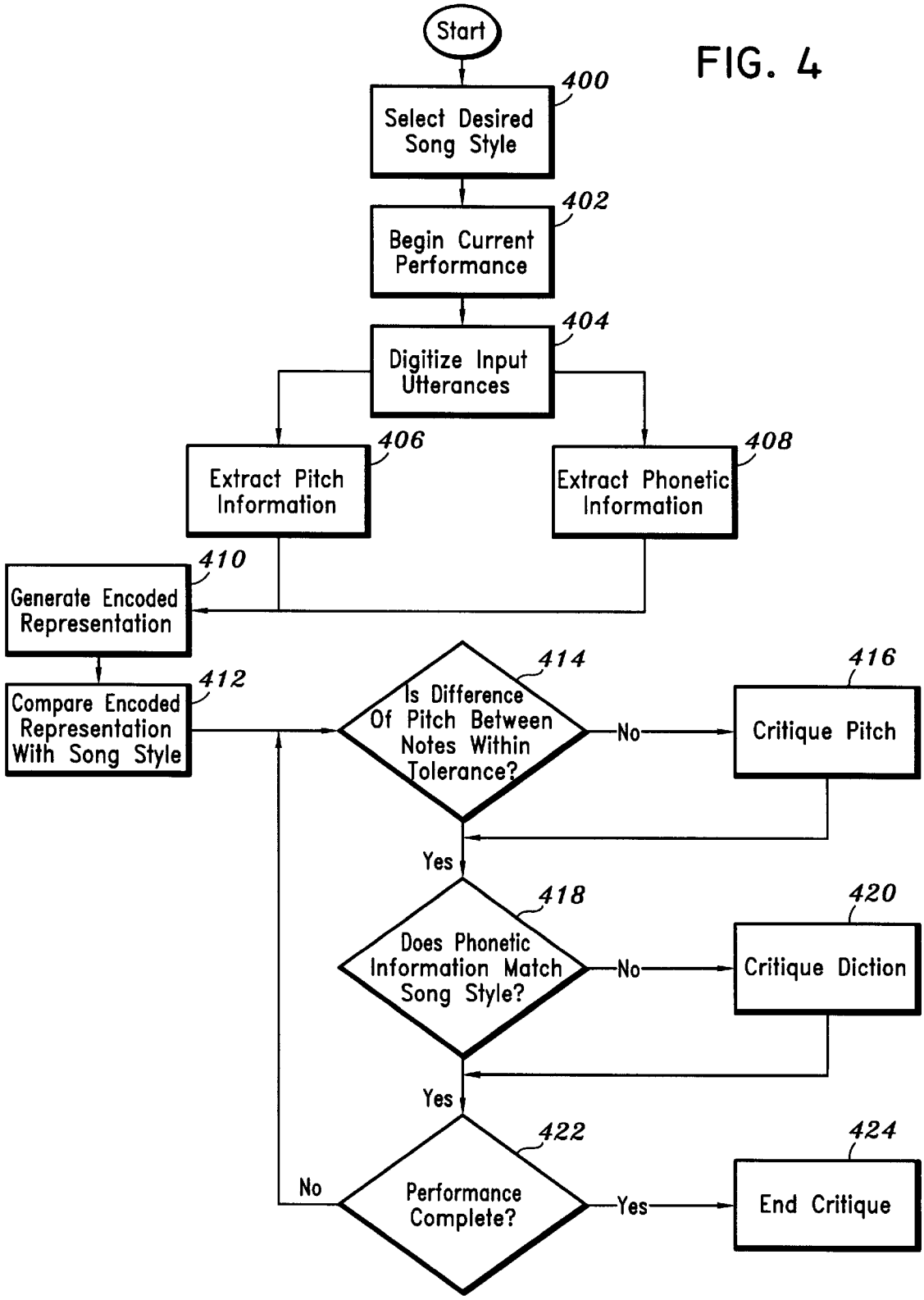
FIG. 4 is flow diagram illustrating a method for providing automatic vocal coaching in accordance with another aspect of the present invention.

Referring now to FIG. 4, a flow diagram illustrates a method for providing vocal coaching in accordance with another aspect of the present invention. Initially, the user will select a particular song style (step 400) from a plurality of stored song styles and the parameters (e.g., phonetic information and change in frequency between successive notes) corresponding to the selected song style will be provided to the audio comparator 116. The singer will then commence a vocal performance (step 402) and the input utterances of the vocal performance are digitized (step 404).

Next, the frequency and phonetic information which is extracted from the digitized input utterances (steps 406 and 408) is encoded (step 410) and then compared (via the audio comparator 116) with the parameters associated with the selected song style (step 412). A critique will be provided if the difference in pitch information between successive notes of the current performance is not within a user-specified tolerance (step 414 and 416) of the corresponding parameter of the selected song style. For example, assume the singer selects a traditional western 12-tone scale song style in which the pitch between successive notes is typically separated by (a multiple of) a particular expected frequency interval (e.g., successive half-steps in the western 12-tone scale differ in frequency by the ratio of the twelfth root of two (~1.0594631) to one.). The vocal coaching system will provide a critique if the extracted pitch information between successive notes is not separated by a multiple of the expected frequency interval (within the given tolerance).

A critique will also be provided if the extracted phonetic information of the current performance does not match the acoustic parameters of the selected song style within a specified tolerance (i.e., the extracted phonetic information indicates an improper sound for the selected song style) (steps 418 and 420). For example, if the vocal coaching system 100 expects a current vocal performance to be sung in English and performed in a classical style, it will provide a critique if the phonetic information of the current performance appears to match pinched or closed vowel sounds instead of desired open vowel sounds.

It is to be appreciated that in the present system and methods described above, the allowable tolerance for variation of the current vocal performance from either the phonetic, pitch and timing information of an encoded reference performance or the parameters of a selected song style will be a configurable setting within the vocal coaching system. For example, if the vocal coaching system is implemented in a multimedia entertainment game for casual users, the system may be configured to ignore deviations in pitch which are smaller than 2% of the target frequency, while a smaller deviation in pitch may be considered worthy of a critique if the system is being utilized by a serious music student during a practice session.

It is to be further appreciated that the vocal coaching system allows the expected pitch information of a reference performance or selected song style to be adjusted. This feature may be utilized, for example, when the desired reference performance is in a range outside of the user's vocal range, whereby the user can transpose the reference performance to an octave which is either higher or lower than the octave in which the original reference performance was sung. In a similar manner, the tolerance for the variation in timing (i.e. when a given change in pitch, or a given change in the phonetic sound being sang, occurs) and the tolerance for variation in the phonetic information are configurable settings within the vocal coach system 100.

Although the illustrative embodiments of the present system and methods have been described herein with reference to the accompanying drawings, it is to be understood that the system and methods described herein are not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. A system for analyzing a vocal performance, comprising:

means for receiving input utterances corresponding to a current vocal performance of a user;

means for extracting pitch information from each frame of said input utterances of said current vocal performance;

means for extracting phonetic information from each frame of said input utterances of said current vocal performance;

means for combining said pitch information and said phonetic information of corresponding frames to generate an encoded representation of said current vocal performance; and means for outputting said encoded representation of said current vocal performance.

2. The system of claim 1, further comprising audio processing means for providing musical accompaniment during said current vocal performance.

3. The system of claim 1, wherein said encoded representation comprises a time-varying sequence of the extracted pitch information and phonetic information.

4. The system of claim 1, wherein said encoding means averages the extracted pitch information of a plurality of successive frames when said encoding means determines that a change in pitch information in the successive frames is below a specified threshold.

5. The system of claim 1, further comprising:

means for storing an encoded representation of a reference vocal performance comprising pitch information and phonetic information; and means for comparing one of said pitch information, phonetic information, and both, of said encoded current vocal performance and of said encoded reference vocal performance to determine if a variation between one of said pitch information, phonetic information, and both, of said current vocal performance and of said reference vocal performance is within a corresponding predetermined tolerance.

6. The system of claim 1, further comprising:

means for storing parameters associated with a song style; and means for comparing said parameters of said song style with one of said pitch information, phonetic information, and both, of said encoded current vocal performance to determine if a variation of the singing style of said current vocal performance and said song style is within a predetermined tolerance.

7. The system of claim 5, wherein said comparing means compares said encoded current vocal performance with said encoded reference vocal performance by comparing the encoded pitch information and phonetic information in corresponding frames of said encoded representations.

8. The system of claim 7, wherein said comparison means determines if a variation between the rhythm of said current vocal performance and the rhythm of said corresponding reference vocal performance is within a corresponding predetermined tolerance by comparing a timing of change of said phonetic information of said encoded current vocal performance and said encoded reference vocal performance on a frame-by-frame basis.

9. The system of claim 5, wherein said comparing means provides critique data when the variation between of one of said pitch information and phonetic information of said encoded current vocal performance and of said encoded reference performance exceeds the corresponding predetermined tolerance.

10. The system of claim 5, wherein said corresponding tolerances are user-programmable parameters.

11. The system of claim 9, wherein said critique data is one of successively provided during said current vocal performance and as batch data at the conclusion of said current vocal performance.

12. A method for analyzing a vocal performance, comprising the steps of:

providing acoustic utterances corresponding to a current vocal performance of a user;

extracting pitch information from each frame of said acoustic utterances;

extracting phonetic information from each frame of said acoustic utterances;

combining said extracted pitch information and phonetic information of corresponding frames to generate an encoded representation of said current vocal performance;

comparing said encoded representation of said current vocal performance with a corresponding encoded reference vocal performance having pitch and phonetic information associated therewith to determine if a variation between one of said pitch information, said phonetic information, and both, of said encoded current vocal performance and of said encoded reference vocal performance is within a corresponding predetermined tolerance; and critiquing the user's current vocal performance if the variation is determined to exceed a corresponding predetermined tolerance.

13. The method of claim 12, wherein said step of critiquing occurs one of during said current vocal performance and after said current vocal performance is completed.

14. The method of claim 12, wherein said step of comparing said encoded current performance with said encoded reference performance comprises comparing the encoded pitch information and phonetic information in corresponding frames of said encoded representations.

15. The method of claim 4, wherein said comparing step further includes the step of:

determining if a variation between the timing of said current vocal performance and the timing of said reference vocal performance is within a corresponding predetermined tolerance by comparing a timing of change of said phonetic information of said encoded current vocal performance and of said reference vocal performance on a frame-by-frame basis.

16. A method for analyzing a vocal performance, comprising the steps of:

providing acoustic utterances corresponding to a current vocal performance of a user;

extracting pitch information from each frame of said acoustic utterances;

extracting phonetic information from each frame of said acoustic utterances;

combining said extracted pitch information and phonetic information of corresponding frames to generate an encoded representation of said current vocal performance;

comparing said encoded representation of said current vocal performance with parameters of a preselected song style to determine if a variation between one of said pitch information, said phonetic information, and both, of said encoded current vocal performance and of said parameters of said song style is within a corresponding predetermined tolerance; and critiquing the user's current vocal performance if the variation is determined to exceed a corresponding predetermined tolerance.

17. The method of claim 16, wherein said step of critiquing occurs one of during said current vocal performance and after said current vocal performance is completed.

18. The method of claim 16, wherein said parameters include phonetic information associated with said preselected song style and pitch difference between successive notes of said preselected song style.

19. The method of claim 18, wherein said step of comparing said encoded current performance with said parameters of said preselected song style includes the steps of:

comparing said pitch information of said encoded current vocal performance with said pitch difference parameter of said preselected song style to determine if said difference in pitch information between successive notes of said encoded current vocal performance varies from said pitch difference parameter associated with said preselected song style within a corresponding predetermined tolerance.

20. The method of claim 18, wherein said comparing step includes the step of:

comparing said phonetic information of said encoded current vocal performance with said phonetic information parameter of said preselected song style to determine if said phonetic information of said encoded current vocal performance varies from said phonetic information parameter associated with said preselected song style within a corresponding predetermined tolerance.

21. The system of claim 1, wherein the means for extracting phonetic information comprises a speech recognition system and wherein the means for extracting the pitch information comprises a frequency extraction system.

22. The system of claim 21, wherein the speech recognition system and frequency extraction system operate in parallel to extract the phonetic and pitch information, respectively, from the current vocal performance.

23. The method of claim 12, wherein said corresponding tolerances are user-programmable parameters.

24. The method of claim 12, wherein the steps of extracting pitch and phonetic information are performed simultaneously.

25. The method of claim 16, wherein said corresponding tolerances are user-programmable parameters.

26. The method of claim 16, wherein the steps of extracting pitch and phonetic information are performed simultaneously.

* * * * *